United States Patent [19]

Seilly et al.

[11] 4,312,316

[45] Jan. 26, 1982

[54] FUEL INJECTION PUMPING APPARATUS

[75] Inventors: Alec H. Seilly, North Wembley; Dorian F. Mowbray, Burnham, both of England

[73] Assignee: Lucas Industries Limited, Birmingham, England

[21] Appl. No.: 94,908

[22] Filed: Nov. 16, 1979

[30] Foreign Application Priority Data

Apr. 7, 1979 [GB] United Kingdom ..... 12311/79

[51] Int. Cl.[3] ..... F04B 17/04

[52] U.S. Cl. ..... 123/499; 123/497; 417/417; 239/585; 239/600

[58] Field of Search ..... 123/497, 499, 503, 504, 123/506; 417/417, 501, 507, 510, 518; 239/585, 600, 88, 89, 91, 95

[56] References Cited

U.S. PATENT DOCUMENTS 3,604,632 9/1971 Eichelman ..... 239/600
4,116,591 9/1978 Mardell ..... 417/417

FOREIGN PATENT DOCUMENTS 966829 8/1964 United Kingdom ..... 417/417

*Primary Examiner*—Charles J. Myhre
*Assistant Examiner*—Carl Stuart Miller

[57] ABSTRACT

A fuel pumping apparatus comprises a housing which defines a boss portion. The boss is hollow and accommodates a pump barrel which is retained in position by means of a sleeve engaging a flange on the barrel. The sleeve is trapped between the flange of the barrel and a flange on a nozzle assembly and the latter is retained by a cap nut which is in screw thread engagement with the boss portion.

10 Claims, 3 Drawing Figures

FUEL INJECTION PUMPING APPARATUS

This invention relates to a fuel injection pumping apparatus for supplying fuel to an internal combustion engine, the apparatus being of the kind comprising an injection nozzle through which fuel can flow and an injection pump for delivering fuel to the nozzle.

Such apparatus is known in the art and in which motive fluid at high pressure is applied to one face of a piston under the control of an electrically operated valve. The piston may directly cause fuel to be expelled from the cylinder in which it is located, to the injection nozzle or it can engage a further piston of reduced diameter which provides the pumping action. In the latter case pressure intensification occurs.

It is known in the art to use electromagnetically operable valves and it is also known to use a fluid pressure actuated valve which is controlled by a control pressure generated by a piezo-electric crystal pressure generator. In practice two such valves may be provided one to control the admission of the motive fluid to the cylinder containing the piston and the other to control the escape of motive fluid from the cylinder. The design and construction of valves capable of operating at the high fluid pressures involved is not an easy task and there is the further problem that a supply of high pressure motive fluid must be provided. The latter means that special provision has to be made on the engine for a pump and an accumulator together with pressure control valves.

It has been found that by careful design of a solenoid and the associated armature, it is possible to actuate the piston which provides the pumping action directly from the armature thereby eliminating the need for the supply of high pressure motive fluid and the aforesaid valves. It is therefore an object of the present invention to provide an apparatus of the aforesaid kind in a simple and convenient form.

According to the invention a fuel injection pumping apparatus of the kind specified comprises a housing defining a boss portion, a fuel injection nozzle secured to said boss portion, means defining a cylindrical bore located within the housing, the nozzle communicating with one end of said bore, a pumping plunger located within said bore, resilient means biasing the pumping plunger away from said one end of the bore, a solenoid core member mounted on the housing, the core member having its axis co-axial with the axis of movement of the pumping plunger, a bore extending axially through the core member, an armature surrounding the core member, a push-rod extending through said axial bore to operatively connect the armature with said plunger, a cover surrounding said armature and defining surfaces to support the armature for axial movement, a fuel inlet into the chamber defined within the cover, grooves formed in the core member whereby the core member defines circumferentially extending ribs, windings in said grooves and arranged so that when electric current is passed therethrough the ribs will assume opposite magnetic polarity, surfaces on said armature corresponding with said ribs whereby when the windings are energized the armature will effect movement of the pumping plunger towards said one end of the bore to displace fuel from the bore to the nozzle and a non-return valve through which fuel can flow into said bore during the return stroke of the plunger under the action of said resilient means.

One example of a fuel injection pumping apparatus in accordance with the invention will now be described with reference to the accompanying drawings in which.

Figure 1:
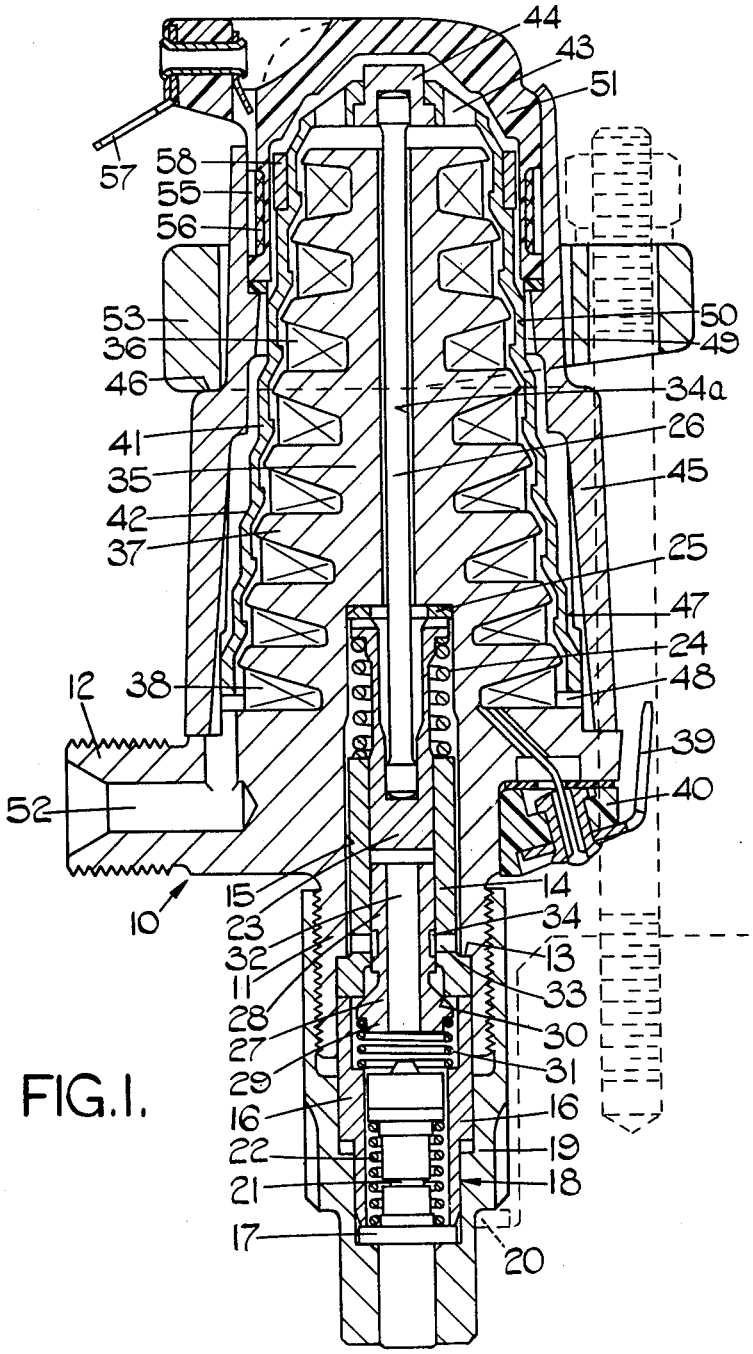
FIG. 1 is a sectional side elevation of the apparatus.
Figure 3:
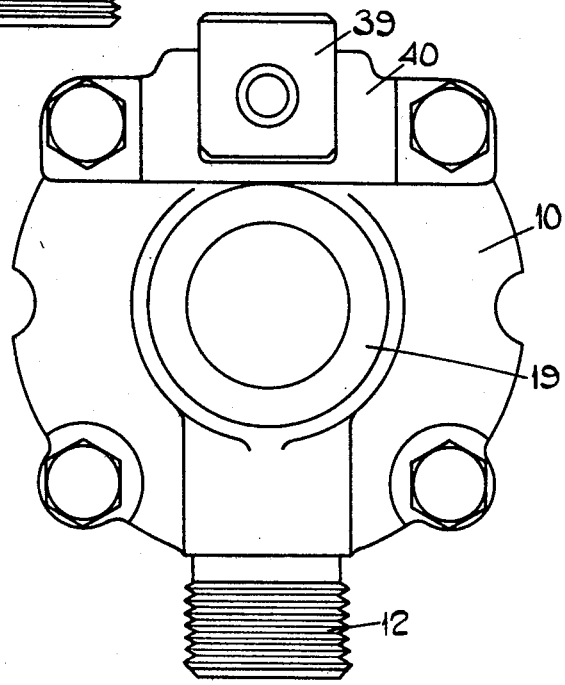
FIG. 3 is an inverted plan view again turned through 90°.

Referring to FIG. 1 of the drawings the apparatus which will hereinafter be referred to as a pump/injector, comprises a housing 10 which as will be seen from FIG. 3, is of generally cylindrical form. The housing 10 is provided with a first boss portion 11 extending axially from the housing and a second boss portion 12 which extends laterally from the housing. Both boss portions are provided with screw threads.

The first boss portion is of hollow form and defines an internal step 13 against which is located the flange of a pump barrel 14. The pump barrel 14 extends with clearance within a cylindrical chamber 15 defined within the housing. The flange of the pump barrel 14 is held in engagement with the step 13 by means of a sleeve 16 one end of which engages the flange. The other end of the sleeve is of reduced diameter and engages with a flange 17 formed on a nozzle assembly generally indicated at 18. The flange 17 of the nozzle assembly is engaged by a retaining nut 19 which is in screw thread engagement with the boss portion 11. The retaining nut defines a cylindrical aperture through which part of the nozzle assembly extends and in use, the end face of this part of the nozzle assembly together with the end face of the retaining nut 19 are exposed within the combustion chamber of an engine. As shown, a step on the retaining nut is located against a copper or like washer shown in dotted outline at 20 and which is located against a step defined in a bore formed in the cylinder head of the engine.

The nozzle assembly includes a valve member 21 one end of which defines a head for co-operation with a seating. The valve member is biased to the closed position by means of a coiled compression spring 22. As will be appreciated by those skilled in the art the nozzle assembly is of the outwardly opening type which when fuel under pressure acts against the aforesaid valve head, the valve member is moved against the action of the spring to permit fuel to flow through an outlet.

Located within the bore defined in the pump barrel is a pumping plunger 23. The pumping plunger extends from the end of the barrel and defines a flange between which and the end of the pump barrel is located a coiled compression spring 24. The flanged end of the pumping plunger is provided with radially extending grooves and the movement of the pumping plunger under the action of the spring 24 is limited by abutment of the pumping plunger with a stop ring 25 which is located against a step defined in the housing. Moreover, the pumping plunger is provided with a recess which as shown, receives the end of a push-rod 26.

Fuel is supplied to the space defined within the housing in a manner which will be explained. This fuel is under a small pressure and during outward movement of the pumping plunger under the action of the spring 24 fuel is drawn into the cylinder defined by the pump barrel. This fuel flows by way of a non-return valve so that when the plunger 23 is moved inwardly against the action of the spring 24 the non-return valve remains closed and the fuel displaced by the pumping plunger is supplied through the nozzle assembly.

The non-return valve comprises a valve member 27 having a shank portion 28 which is slidably supported within the bore in the pump barrel. The valve member also includes a valve head 29 which is of larger diameter than the shank portion and this in the closed position of the valve member engages with an annular edge 30 defined at the end of an enlarged portion of the bore in the barrel. The valve member is urged to the closed position by a compression spring 31 and extending through the valve member is a bore 32. In addition, the barrel 14 is provided adjacent the flange, with a pair of radially extending ports 33. At their outer ends the ports 33 communicate with the space defined between the outer periphery of the pump barrel and the wall 15 of the chamber formed in the housing. At the inner ends, the ports communicate with a circumferential groove 34 formed in the periphery of the shank 28 of the valve member. Moreover, the shank 28 of the valve member is of a length such that towards the end of the stroke of the pumping plunger, the latter will engage with the shank and lift the valve member against the action of the spring 31. When this occurs towards the end of delivery of fuel by the pumping plunger, the pressure of fuel supplied to the nozzle is lowered to that obtaining in the chamber containing the pump barrel. The reason for this is that when the valve member is lifted the groove 34 places the ports 33 in communication with the enlarged portion of the bore beneath the head of the valve member. As a result of the rapid reduction in the fuel pressure, the risk of fuel being supplied through the nozzle assembly in an unatomised condition is minimised.

When the pumping plunger is returned under the action of the spring 24 the valve member 27 remains in a position such that the ports 33 are in communication with the bore and with the head 29 lifted from the edge 30. The reason for this is that fuel under pressure from the aforesaid chamber acts on the valve head and flow of fuel occurs into the bore occupied by the pumping plunger. The flow of fuel into the bore continues until the movement of the plunger is halted either by the stop ring 25 or earlier as will be explained. As soon as movement of the plunger 23 is halted no further fuel can flow into the bore and the fluid pressures acting on the valve member are equalised. As a result the valve member moves under the action of the spring 31 until the head engages the aforesaid edge. The communication of the ports 33 with the bore is therefore broken.

An electromagnetic device is provided for effecting movement of the piston 23. This movement is achieved through the push rod 26 which extends with clearance through a drilling 34 formed in a core member 35 conveniently formed integrally with the housing 10. The core member extends on the opposite side of the housing to the first boss portion 11. The core member is formed from magnetisable material and therefore in the present construction so is the housing 10. It will be appreciated however that the core member and the housing may be formed as separate parts.

The core member is of generally truncated conical configuration and it is provided with a plurality of circumferentially extending grooves 36. The grooves 36 define circumferentially extending ribs 37 and it will be noted that the further a particular rib is from the housing 10 the smaller is its diameter. Moreover, this also applies to the depth of the grooves 36 and in general the width of the grooves increases as the distance from the housing 10 increases.

The outer surfaces of the ribs 37 are inclined to the axis of the core member and located within each groove is a winding 38. The windings conveniently are connected in series in such a fashion that when electric current is passed through the windings the direction of current flow in adjacent windings is in the opposite direction. In this manner adjacent ribs 37 when electric current is passed through the windings, will be magnetized to opposite magnetic polarity. Conveniently one end of the series connected windings is connected to the core member while the other end of the series connected windings is connected to a terminal 39 which is carried by an electrically insulating block 40 which is secured to the housing 10 as shown in FIG. 3.

Surrounding the core member is an armature 41. This is also formed from magnetisable material and has a thin section. The armature 41 can be regarded as a number of hoops of reducing diameter connected together by inclined portions such as shown at 42, the internal faces of the inclined portions lying substantially parallel to the aforesaid faces of the ribs 37. The armature is of cupshaped form and the base wall is provided with a pair of apertures 43 and a central aperture which receives a plug 44 in which is located the remote end of the push rod 26. In use, when the windings are supplied with electric current, the armature will move downwardly as shown in the drawing to reduce the reluctance of the air gaps between the ribs and the inclined portions 42 of the armature. In so doing movement will be imparted to the pumping plunger 23.

Surrounding the armature is a hollow cover 45 which is formed from non-magnetic material and conveniently as a die casting from a zinc based alloy. As will be seen from the drawing the cover has a stepped outer peripheral surface and the sides thereof taper to permit its withdrawal from the die cavity. The internal peripheral surface is also of stepped form and is shaped as will be described, to support the armature for axial movement. The end portion of the cover that is to say in general that portion extending between the aforesaid external step which is referenced 46 and the housing 10, is formed with four internal ribs 47 and defined between these ribs are recesses. As explained in order to permit the casting to be removed from the die, the internal surfaces are tapered. After removal from the die cavity, the ribs 47 are machined so as to define surfaces which extend parallel to the axis of the core member. As a result four bearing surfaces 48 are formed which are engaged by the armature at its wider end.

Figure 2:
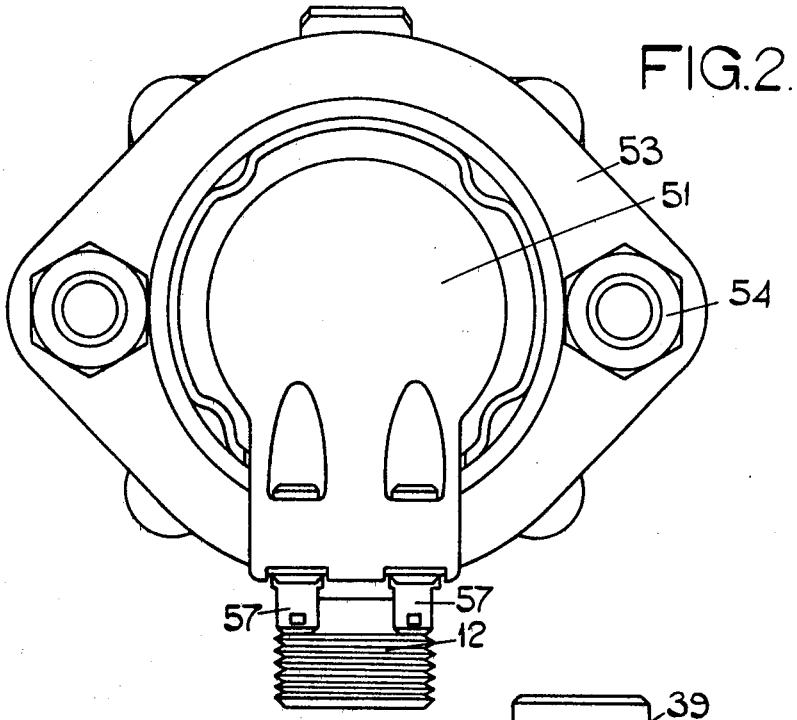
FIG. 2 is a plan view of the apparatus turned through 90° as compared with FIG. 1

The cover is provided with four further ribs 49 and again when manufactured these are tapered to permit removal of the casting from the die. Subsequently the internal surfaces of the ribs 49 are machined to provide bearing surfaces 50 engaging with complementary surfaces of the armature nearer the narrow end thereof. The open end of the cover is closed by a non-metallic closure member 51 which is of generally cup-shaped form. The wall of the closure member extends within the cover and the end portion engages a sealing ring located against a step defined adjacent the ribs 49. The closure member 51 is retained by suitable deformation of the end portion of the cover. This is clearly shown in FIG. 2. The space defined within the cover 45 is connected to a fuel inlet 52 formed in the boss 12 and in use, fuel can flow upwardly on the inside or the outside of the armature through the apertures 43 if it has flowed upwardly on the outside of the armature and down the drilling 34 to the bore 15 in the housing. Thus cooling of the windings is achieved by the fuel. The pump/injector is retained in position within the bore in the cylinder head by means of a clamping ring 53 which is in engagement with the step 46 on the cover. The clamping ring is provided with a pair of ears in which are located apertures through which extend in use, threaded studs secured within apertures formed in the cylinder head of the engine. A pair of nuts 54 are engaged with the studs. One stud is shown in dotted outline in FIG. 1.

The skirt of the end closure 51 is provided in its external peripheral surface, with a circumferential groove 55. The groove accommodates a single layer electrical winding 56 the ends of which are connected to terminals 57 carried by the end closure. The armature 41 mounts a ring 58 formed from electrically conductive material and when alternating current is supplied to the winding 56 eddy currents will flow in the ring 58 which will vary the inductance of the winding 56. The extent of variation of the inductance depends on the length of the portion of the ring which is located within the winding and since the ring is mounted on the armature the inductance provides a measure of the axial position of the armature.

In use, if it is required to deliver the maximum volume of fuel then the pumping plunger 23 is allowed to move its maximum extent under the action of the spring 24. The windings may be de-energized immediately after delivery of fuel has taken place or they can be de-energized at some time before the next delivery of fuel is required, providing sufficient time is allowed for the fuel to flow into the bore in the pump barrel.

If it is required that the pump/injector should deliver less than its maximum volume of fuel then the return motion of the armature under the action of the spring 24 must be halted at some intermediate position. The aforesaid transducer provides a signal indicative of the position of the armature and therefore the pumping plunger, and using this signal it is possible to partly energize the windings when the pumping plunger has moved the required amount. Such partial energization of the windings creates sufficient force to hold the armature against the action of the spring 24 but it does not pressurize the fuel by an amount sufficient to effect opening of the valve member 21 of the nozzle assembly. It will be apparent that filling the bore in the barrel can take place at any time after the termination of fuel delivery and before the next delivery of fuel is required. It must be remembered however that the filling of the bore with fuel does take a finite time and therefore if it is decided to fill immediately before delivery of fuel is required, sufficient time must be allowed for the filling to take place.

It is clearly desirable that the design of the solenoid should be optimized so that the maximum performance is available for the minimum weight of material. Such optimization is achieved by varying the width and the depth of the grooves 36. The thinner and deeper the grooves then the greater will be the flux leakage between the faces of the grooves. As will be seen from FIG. 1 the grooves are of tapered form and this helps to minimise flux leakage. In addition the grooves are so dimensioned that the winding areas of the grooves are substantially constant. Moreover, the ribs 37 are dimensioned such that the circumferential rim area is substantially equal at the tip and also at the root so that the flux density in the material forming the ribs remains substantially constant throughout the thickness of the ribs.

We claim:

1. A fuel injection pumping apparatus for supplying fuel to an internal combustion engine and comprising an injection nozzle through which fuel can flow and an injection pump for delivering fuel to the nozzle, the apparatus including a housing defining a boss portion, a fuel injection nozzle secured to said boss portion, a hollow pump barrel defining a cylindrical bore located within the housing, said pump barrel having a peripheral flange at one end for engagement with a step defined in the housing, a hollow cylindrical member engaging with the side of said flange remote from the step, a flanged nozzle assembly engaged with said hollow cylindrical member and a cap nut engaged with said nozzle assembly and in screw thread engagement with the boss portion of the housing, the nozzle communicating with one end of said bore, a pumping plunger located within said bore, resilient means biasing the pumping plunger away from said one end of the bore, a solenoid core member mounted on the housing, the core member having its axis co-axial with the axis of movement of the pumping plunger, a bore extending axially through the core member, an armature surrounding the core member, a push-rod extending through said axial bore to operatively connect the armature with said plunger, a cover surrounding said armature and defining surfaces to support the armature for axial movement, a fuel inlet into the chamber defined within the cover, grooves formed in the bore member whereby the core member defines circumferentially extending ribs, windings in said grooves and arranged so that when electric current is passed therethrough the ribs will assume opposite magnetic polarity, surfaces on said armature corresponding with said ribs whereby when the windings are energized the armature will effect movement of the pumping plunger towards said one end of the bore to displace fuel from the bore to the nozzle and a non-return valve through which fuel can flow into said bore during the return stroke of the plunger under the action of said resilient means.

2. An apparatus according to claim 1 in which said nonreturn valve comprises a valve member having a shank portion slidable within said one end of the cylindrical bore and a valve head of larger diameter than the shank portion, a seating defined on said pump barrel for engagement with said head, and resilient means acting between said head and a step defined on the internal surface of said hollow cylindrical member and acting to urge said head into contact with the seating.

3. An apparatus according to claim 2 including a passage extending through said valve member and acting to permit fuel displaced from the cylindrical bore by the plunger to flow to the nozzle, the shank portion of the valve member being of a length so that it is engaged by the plunger towards the end of the stroke thereof, the space beneath the head of the valve member when the valve head is lifted from the seating being in communication with said chamber whereby the pressure of fuel supplied to the nozzle is reduced to the pressure within the chamber.

4. An apparatus according to claim 3 in which said space is in communication with said chamber by way of a port formed in the wall of said pump barrel, a groove on said valve member and which when the valve head is lifted from the seating places said port in communication with said space, an annular space surrounding the pump barrel and said bore formed in the core member.

5. An apparatus according to claim 4 in which the resilient means biasing the plunger comprises a coiled compression spring positioned between the end of said pump barrel and flange on the plunger, the apparatus also including means for limiting the extent of movement of the plunger under the action of the spring.

6. An apparatus according to claim 5 in which said means for limiting the extent of movement of the plunger comprises a stop ring for engagement with the flanged end of the plunger, said stop ring being positioned at the end of a cylindrical chamber defined in the housing and in which is located said pump barrel.

7. An apparatus according to claim 1 in which said cover defines a step on its external surface whereby in use the apparatus can be retained in position on an engine.

8. An apparatus according to claim 1 in which the cover is of hollow form and at one end engages the housing, the other end of the cover being closed by an end closure.

9. An apparatus according to claim 8 in which said end closure has a skirt portion which extends within the cover for engagement with a ledge defined in the internal surface of the cover.

10. An apparatus according to claim 9 in which the skirt portion of the end closure is provided with a circumferential groove in its outer surface, a single layer winding in said groove and a ring of electrically conductive material carried by the armature, said ring being disposed adjacent the winding whereby in use, when the winding is supplied with electric current eddy currents will be induced in said ring and the inductance of the winding will vary with the position of the armature.

* * * * *